US008126165B2

(12) United States Patent
Kondo et al.

(10) Patent No.: US 8,126,165 B2
(45) Date of Patent: Feb. 28, 2012

(54) CONDENSER MICROPHONE

(75) Inventors: Kazuhisa Kondo, Machida (JP); Chung-Hsien Tseng, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 434 days.

(21) Appl. No.: 12/399,630

(22) Filed: Mar. 6, 2009

(65) Prior Publication Data

US 2009/0232335 A1 Sep. 17, 2009

(30) Foreign Application Priority Data

Mar. 13, 2008 (JP) ..... 2008-064094

(51) Int. Cl.
*H04R 3/00* (2006.01)

(52) U.S. Cl. ..... 381/113; 381/92; 381/111

(58) Field of Classification Search ..... 381/92, 381/111, 112, 113, 122, 312
See application file for complete search history.

(56) References Cited

U.S. PATENT DOCUMENTS

| | | | | |
|---|---|---|---|---|
| 5,978,491 | A | 11/1999 | Papadopoulos | |
| 6,057,737 | A * | 5/2000 | Pritchard | 330/300 |
| 6,084,972 | A | 7/2000 | van Halteren et al. | |

FOREIGN PATENT DOCUMENTS

| | | | |
|---|---|---|---|
| EP | 0 431 537 | A | 6/1991 |
| EP | 0 800 331 | A | 10/1997 |
| FR | 2 596 191 | A | 9/1987 |
| JP | 5-327380 | A | 12/1993 |
| JP | 6-204755 | A | 7/1994 |
| JP | 09-182185 | A | 7/1997 |
| JP | 10-241105 | A | 9/1998 |
| JP | 11-266499 | A | 9/1999 |
| JP | 2001-189988 | A | 7/2001 |
| JP | 2001-238287 | A | 8/2001 |
| JP | 2006-352622 | A | 12/2006 |
| JP | 2007-129619 | A | 5/2007 |
| WO | 03/086013 | A1 | 10/2003 |
| WO | 03/086014 | A | 10/2003 |

OTHER PUBLICATIONS

Matsushita Electric Industrial Kogakuin, Electricity Basic Lecture 6, Basic Electronic Engineering through Programmed Learning, Electronic Circuit II, Matsushita Electric Industrial Co., Ltd., Jun. 1, 1976, pp. 35, 41-45, Japan.

* cited by examiner

*Primary Examiner* — Hoai V Pham
(74) *Attorney, Agent, or Firm* — Sughrue Mion, PLLC

(57) ABSTRACT

A condenser microphone comprising: a mic capsule in which a capacitor is composed of a diaphragm and a counter electrode, and which effects electroacoustic conversion; a FET for impedance-converting audio signals output from the mic capsule; and a CR circuit composed of a resistor and a capacitor, and connected to the FET to adjust a signal level in a low frequency range, and in the condenser microphone, an output terminal may be drawn out from a drain of the FET; and the CR circuit may be connected in between a source of the FET and the ground, furthermore, in the condenser microphone, there may be provided a changeover switch for switching a mode in which the CR circuit is connected in between the source of the FET and the ground into another mode in which the CR circuit is short-circuited to connect the source of the FET to the ground.

2 Claims, 6 Drawing Sheets

RELATED ART

RELATED ART

RELATED ART

CONDENSER MICROPHONE

BACKGROUND OF THE INVENTION

1. Field of the Invention

The present invention relates to a condenser microphone, and more particularly to an electric circuit which can activate characteristics of an impedance converter housed therein, and adjust the frequency characteristic thereof while reducing devices to be used.

2. Description of the Related Art

When wind blows, or vibration arises, remarkable noises appear in audio signals. These noises are referred to as wind noise, and vibration noise. Frequency components of these noises reside in a low frequency range, so that when the lower side of frequency response characteristics of a microphone is made to attenuate, it becomes possible to suppress the appearance of the above-described noises and to make easy the collection of target sounds.

In a microphone unit housing an impedance converter as in a condenser type microphone unit, frequency characteristics are decided generally dependent on an electric acoustic converter, i.e. a microphone capsule (hereinafter referred to as "mic capsule") which is located on the upstream of the above-described impedance converter. Furthermore, there is known such a method that the level of signals output from a drain side of a FET constituting an impedance converter is adjusted in every frequency range by means of a CR filter composed of a capacitor and a resistor, whereby the signal level is attenuated.

FIG. 4 is an example of a general circuit diagram showing a conventional condenser microphone. In FIG. 4, a microphone unit 1 includes a mic capsule 2 and a FET 3 functioning as an impedance converter. As is well-known, the mic capsule 2 is composed of a diaphragm made of a thin film and a counter electrode which is opposed to the diaphragm with a predetermined gap and constitutes the capacitor together with the diaphragm. The microphone unit 1 is constituted by containing a diaphragm holder, a circuit board and the like in addition to the mic capsule 2 into a unit case or the like. One of output terminals of the mic capsule 2 is connected to a gate of the FET 3, while the other end is grounded. The drain of the FET 3 is connected to a positive electrode of a power source Vcc through a resistor Rd, and a source of the FET 3 is grounded. An output terminal 5 is drawn out from the drain of the FET 3.

The frequency characteristics of the conventional example shown in FIG. 4 are decided by means of the mic capsule 2 as mentioned above. To adjust the frequency characteristics of the condenser microphone unit, it is necessary to add a filter circuit composed of, for example, a capacitor, a resistor and the like to the output terminal 5 or a site which is integrated electrically therewith. Furthermore, for the sake of suppressing or eliminating the above-described wind noise or vibration noise which gets mixed in the audio signal converted electroacoustically, the characteristics of the above-described filter circuit should be set so as to attenuate the frequency in low frequency range.

FIG. 5 shows another example of a conventional condenser microphone. The constitution of a microphone unit in FIG. 5 is the same as that of the conventional example shown in FIG. 4 wherein the same reference numerals are given to the same components as those of the conventional condenser microphones shown in FIGS. 4 and 5. In FIG. 5, a drain of a FET 3 is connected to the positive electrode of a power source Vcc, while a source of the FET 3 is grounded through a resistor R1. The source of the FET 3 is also connected to a base of a transistor Q1 through a capacitor C1 and an opening/closing switch 4, and a resistor R2 is connected in parallel to the switch 4. The switch 4 is a member for switching frequency characteristics of the microphone, and the switch 4 functions to open and close a route between the capacitor C1 and the base of the transistor Q1. As illustrated in FIG. 5, a resistor R2 is made to be effective thereby to obtain flat frequency characteristics in the case that the route is in an opened condition. When switched to a closed condition, the resistor R2 is made to be ineffective (short-circuited), whereby such frequency characteristics that the low frequency range thereof is allowed to attenuate are achieved. It is arranged in such that a collector of the transistor Q1 is connected to the positive electrode of the power source Vcc, an emitter is grounded through a resistor R5, and an output terminal 5 is connected to the emitter to output a signal from the emitter. A resistor R3 is connected across a base of the transistor Q1 and the positive electrode of the power source Vcc, while a resistor R4 is connected across the base and the ground. Accordingly, it is adapted in such that the power source voltage Vcc is partially pressurized by means of the resistors R4 and R3 to apply the voltage to the base of the transistor Q1.

In a conventional example shown in FIG. 5, the transistor Q1 functions as a buffer amplifier for preventing the influence of the input impedance of a microphone amplifier and the like which is to be connected on the downstream of the circuit. Although it is possible to adjust frequency characteristics by incorporating a filter circuit with the use of a CR without using the buffer amplifier, the performance is somewhat influenced. In the example shown in FIG. 5, although the output terminal 5 is drawn out from the source of the FET 3, it is possible to draw out the output terminal from the drain, or it is also possible to cut or reduce a low frequency range. The resistor R2 connected in parallel to a switch 4 functions also so as not to produce noises due to opening and closing the switch 4 by keeping a voltage between opposed ends of the capacitor C1 constant.

According to the conventional examples shown in FIGS. 4 and 5, it is required to constitute an electric circuit by adding a circuit element to the outside of the condenser microphone unit 1 for eliminating wind noise or vibration noise.

Incidentally, there is adopted a so-called plug-in power system wherein the power source of a variety of instruments in which a microphone is used, for example, that of a video recorder and the like is utilized also as the power source for the condenser microphone. The system functions in such that when a condenser microphone is mounted on an instrument such as a video recorder, a circuit is connected in a manner wherein a power source is supplied from that of the above-described instrument into the condenser microphone.

However, it is impossible to obtain such constitution that frequency characteristics can be adjusted in the instrument adopting the plug-in power system according to the conventional condenser microphones shown in FIGS. 4 and 5.

A variety of techniques by which frequency response of acoustical signals is suitably set or made to be variable in acoustical instruments is proposed (for example, see Patent Document 1, Patent Document 2, Patent Document 3, Patent Document 4, and Patent Document 5).

However, the inventions described in these Patent Documents do not have the peculiar constitution in the condenser microphone according to the invention of the present application, but no prior art of the condenser microphone relevant to the same technical idea as that of the invention of this application was found.

[Patent Document 1] Japanese Patent Application Laid-open No. 5-327380

[Patent Document 2] Japanese Patent Application Laid-open No. 10-241105

[Patent Document 3] Japanese Patent Application Laid-open No. 2007-129619

[Patent Document 4] Japanese Patent Application Laid-open No. 2001-189988

[Patent Document 5] Japanese Patent Application Laid-open No. 6-204755

SUMMARY OF THE INVENTION

An object of the present invention is to provide a condenser microphone which can afford attenuation function on a low frequency range side with a simple circuit constitution by composing an electric circuit with utilization of a FET as an impedance converter included in the condenser microphone without adding an external circuit.

Another object of the present invention is to provide such a condenser microphone which can afford easily attenuation function on a low frequency range side in even a condenser microphone of a so-called plug-in power system.

The present invention is characterized most principally by having a mic capsule in which a capacitor is composed of a diaphragm and a counter electrode, and which effects electroacoustic conversion; a FET for impedance-converting audio signals output from the mic capsule; and a CR circuit composed of a resistor and a capacitor, and connected to the FET to adjust a signal level in a low frequency range.

In the condenser microphone, an output terminal may be drawn out from a drain of the FET; and the CR circuit may be connected in between a source of the FET and the ground.

The condenser microphone may be provided a switch for switching a mode wherein the CR circuit is connected in between the source of the FET and the ground into another mode wherein the CR circuit is short-circuited to connect the source of the FET to the ground.

In the case that an instrument to which the microphone is to be connected adopts plug-in power system and the microphone can receive power supply from the instrument by connecting the microphone to the instrument, the microphone may be a condenser microphone which fits in with the plug-in power system.

Since the CR circuit which can adjust a signal level in a low frequency range is connected to the FET which impedance-converts audio signals output from the mic capsule, the condenser microphone of the present invention can afford attenuation function on a low frequency range side with a simple circuit construction without adding any external circuit.

According to the condenser microphone of the present invention, even if an instrument to which the microphone is to be connected belongs to plug-in power system, the microphone can afford attenuation function on a low frequency range side.

DETAILED DESCRIPTION OF THE INVENTION

Figure 1:
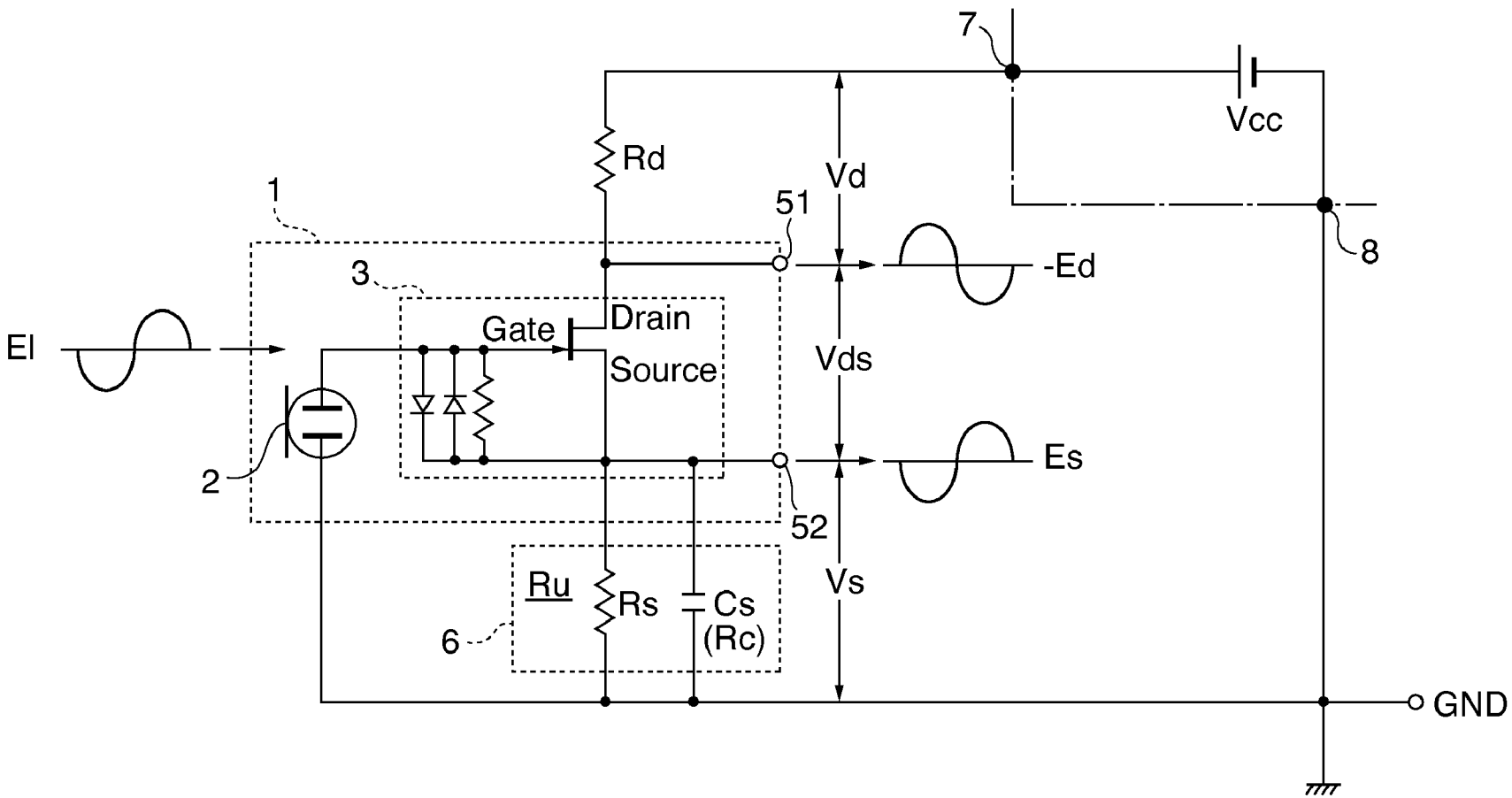
FIG. 1 is a circuit diagram showing an example of a condenser microphone according to the present invention.

In the following, examples of the condenser microphone according to the present invention will be described by referring to the accompanying drawings wherein the same reference numerals are given to the same components as those of the constitutions of the conventional examples shown in FIGS. 4 and 5.

FIRST EXAMPLE

In FIG. 1, a microphone unit 1 is provided with a mic capsule 2 and a FET 3 functioning as an impedance converter. As mentioned already, the mic capsule 2 is constituted by including a diaphragm made of a thin film, and a counter electrode opposed to the diaphragm with a predetermined gap and constituting a capacitor together with the diaphragm. In addition to the mic capsule 2, diaphragm holder, circuit board and the like are contained in a unit case or the like, whereby the microphone unit 1 is constituted. The above-described diaphragm oscillates by receiving acoustic waves in accordance with acoustic pressure so that the electrostatic capacity of a capacitor constituted by the diaphragm and the counter electrode varies, and this variation is output as a variation of electric signals. Namely, the mic capsule 2 is an electroacoustic transducing device.

An end of the output terminals of the mic capsule 2 is connected to a gate of the FET 3, while the other end thereof is grounded. A drain of the FET 3 is connected to a positive electrode of a power source Vcc through a resistor Rd. A source of the FET 3 is grounded through a CR circuit 6 constituted by connecting a resistor Rs in parallel to a capacitor Cs. The CR circuit 6 functions as a filter. An output terminal 51 is drawn out from the drain of the FET 3, and an output terminal 52 is also drawn out from the source of the FET 3. With respect to the signals output from the output terminal 51, the signals of opposite phase are output from the output terminal 52. There is not required to provide both the output terminals 51 and 52, but it is sufficient to provide either of the terminals, e.g. the output terminal 51.

The characteristic feature of the example is to provide the above-described CR circuit 6. The CR circuit 6 is a kind of filter, and adjusts a level of the signal which is electroacoustically converted in the mic capsule 2 and impedance-converted in the FET 3 in response to a frequency, whereby the frequency characteristics are regulated. To reduce wind noise or vibration noise, a value of the resistor Rs in the CR circuit 6 and a capacity of the capacitance Cs are set to such a value that a low frequency range attenuates. The CR circuit 6 is connected between the source of the FET 3 and the ground (GND) so as to actuate the characteristics of the bias built-in type FET 3. Since the FET 3 is contained in a unit case together with the mic capsule 2, a circuit board and the like to constitute the microphone unit 1, the CR circuit 6 may also be incorporated into the above-described circuit board so that it can be contained in the unit case.

Figure 4:
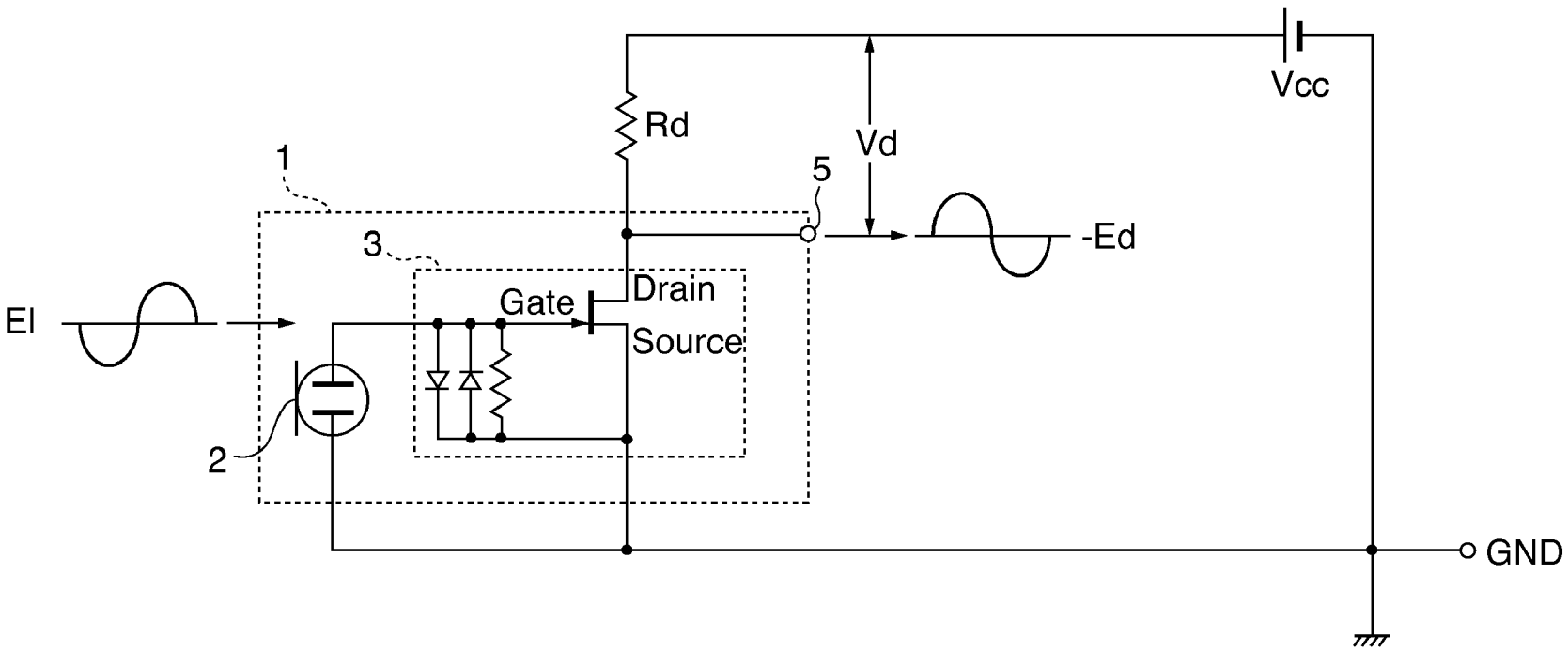
FIG. 4 is a circuit diagram showing an example of a conventional condenser microphone.
Figure 5:
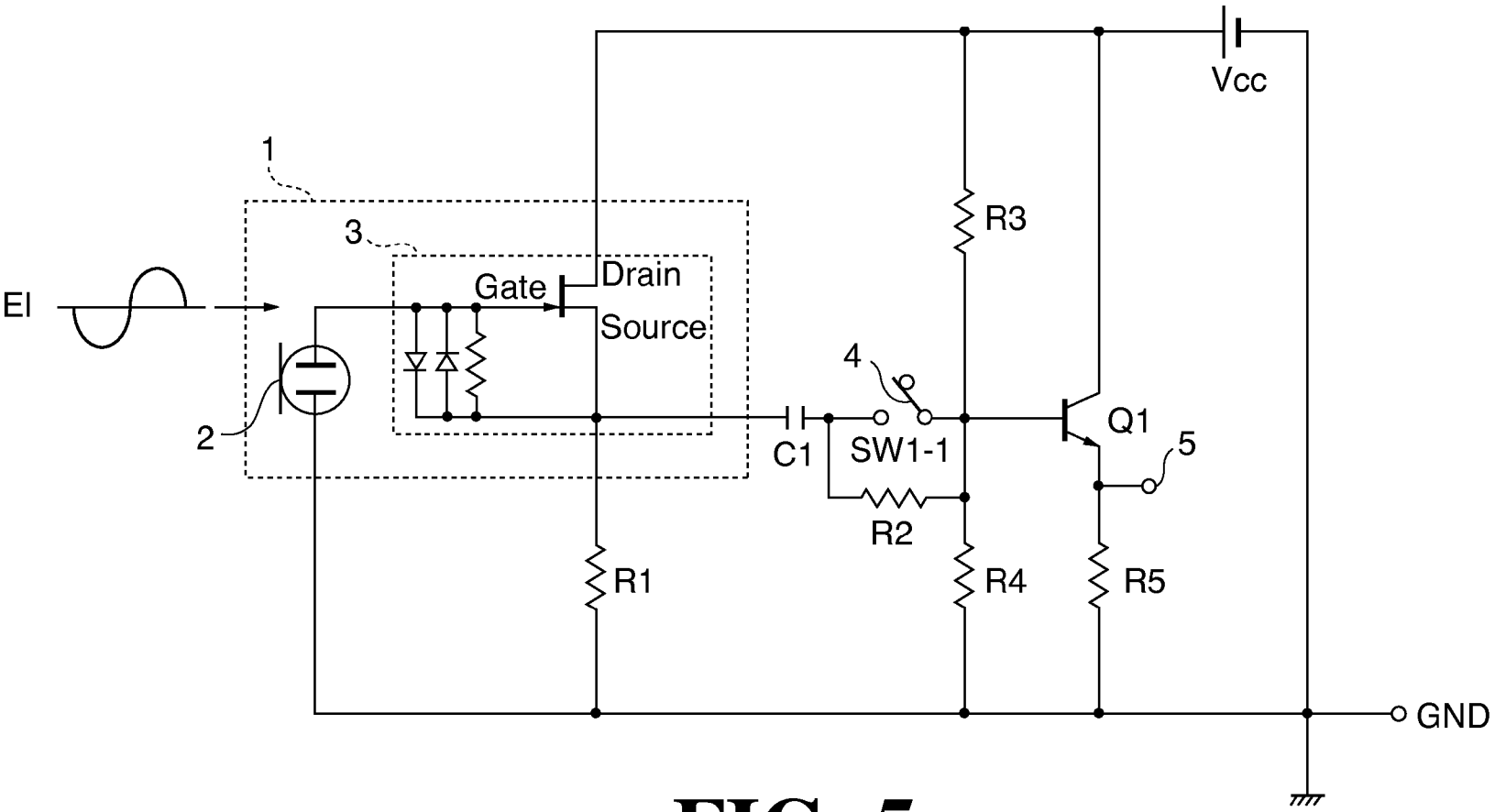
FIG. 5 is a circuit diagram showing another example of a conventional condenser microphone.

In the case that a filter including a CR circuit for reducing a low frequency range to decrease wind noise, vibration noise and the like is incorporated into a conventional condenser microphone, the filter must be attached externally to the output terminal of a microphone unit as described with respect to the conventional examples shown in FIGS. 4 and 5. Accordingly, there is no such conception that the filter as mentioned above is contained within a microphone unit as to a conventional condenser microphone. Furthermore, according to the example of the present invention as shown in FIG. 1, the CR circuit 6 is connected between the source of the FET 3 and the ground so as to actuate the characteristics of the bias built-in type FET 3, whereby the attenuation characteristics of a low frequency range are achieved by a small number of circuit elements.

According to the above-described example, it is effective in the case that a microphone is constituted as a microphone of the above-mentioned plug-in power system. The plug-in power system means, as mentioned already, such system that when a condenser microphone is mounted on an instrument such as a video recorder, the circuit is connected in such a manner that a power source is supplied to the condenser microphone from the above-described instrument. In order to constitute the microphone according to the above-described example as a plug-in power system microphone, for instance, an area is divided into that on the side of the microphone and that on the side of the instrument by the boundary of a connection point 7 of the drain of the FET 3 and the resistor Rd as well as a connection point 8 reaching to the ground GND. When the microphone is mounted on the instrument, it is adapted in such that the microphone is connected to the instrument through the connection points 7 and 8, whereby a power source for a voltage Vcc is supplied from the power source housed in the side of the instrument.

According to the example shown in FIG. 1, since the CR circuit 6 for attenuating a low-frequency range level is incorporated in the microphone unit 1, attenuation function for the low-frequency range level can be afforded on the microphone in even the case that such a microphone using the microphone unit 1 is made to be that of a plug-in power system without adding any separate circuit.

On the other hand, according to the conventional condenser microphones as shown in FIGS. 4 and 5, since there is no such conception that attenuation function for a low-frequency range level is afforded on the condenser microphone in the case that the microphone is used in the form of a plug-in power system, the low-frequency range level cannot be attenuated with respect to the output from the microphone unit 1.

Next, a behavior, particularly an attenuation behavior in the low frequency range level of the example shown in FIG. 1 will be described. A power source voltage is designated by Vcc, a terminal voltage of the resistor Rd is represented by Vd, a voltage between the drain-source of the FET 3 is represented by Vds, and a terminal voltage of the CR circuit 6 is designated by Vs. Furthermore, an output voltage of the mic capsule 2 is designated by Ei, a drain voltage of the output terminal 51, i.e. FET 3 is represented by Ed, and a source voltage of the output terminal 52, i.e. FET 3 is represented by Es wherein a value of each resistor is represented by a sign added to the resistor, respectively.

In the case that each operating voltage is Vd≈Vds≈Vs, the Rd and Ei are represented as follows:

$$Rd \approx Rs, \text{ and } Ei \approx Es \approx Ed$$

When it is assumed that the Rs is extremely small, it results in Es<<−Ed. In this case, an input signal Ei from the mic capsule 2 is amplified, and a degree of amplification A is represented by A=|yfs|Rd wherein yfs is a small signal transfer admittance.

In the example shown in FIG. 1, the CR circuit 6 constituted by connecting the capacitor Cs in parallel to the resistor Rs is connected in between the source of the FET 3 and the ground GND, so that such a constitution that a current feedback loop composed of the CR circuit 6 is further added is obtained. In this case, the capacitor Cs depends on frequency, and the resistance value Rc is represented by the following equation:

$$Rc=1/\omega c=1/2\pi fc$$

Accordingly, the resistance value Rc of the capacitor Cs is high in a low frequency, so that the resistance value of the resistor Rs becomes dominant. Therefore, when a resistance of the CR circuit 6 is represented by Ru, it results in Ru≈Rs, and when Rs is an extremely larger value than Rd, it results in Es>>−Ed.

On the contrary, in case of a high frequency, a resistance value Rc of the capacitor Cs is low, and a resistance value of the resistor Rs is ignored so that it results in Ru≈Rc. When Rc has an extremely small value with respect to Rd, Es<<−Ed is obtained.

Thus, an output signal level of the output terminal 51 exhibits such characteristics which are restrained in a low frequency range, so that it becomes possible to attenuate wind noise and vibration noise contained in a low frequency range, whereby a target clear sound signals can be output.

Figure 3:
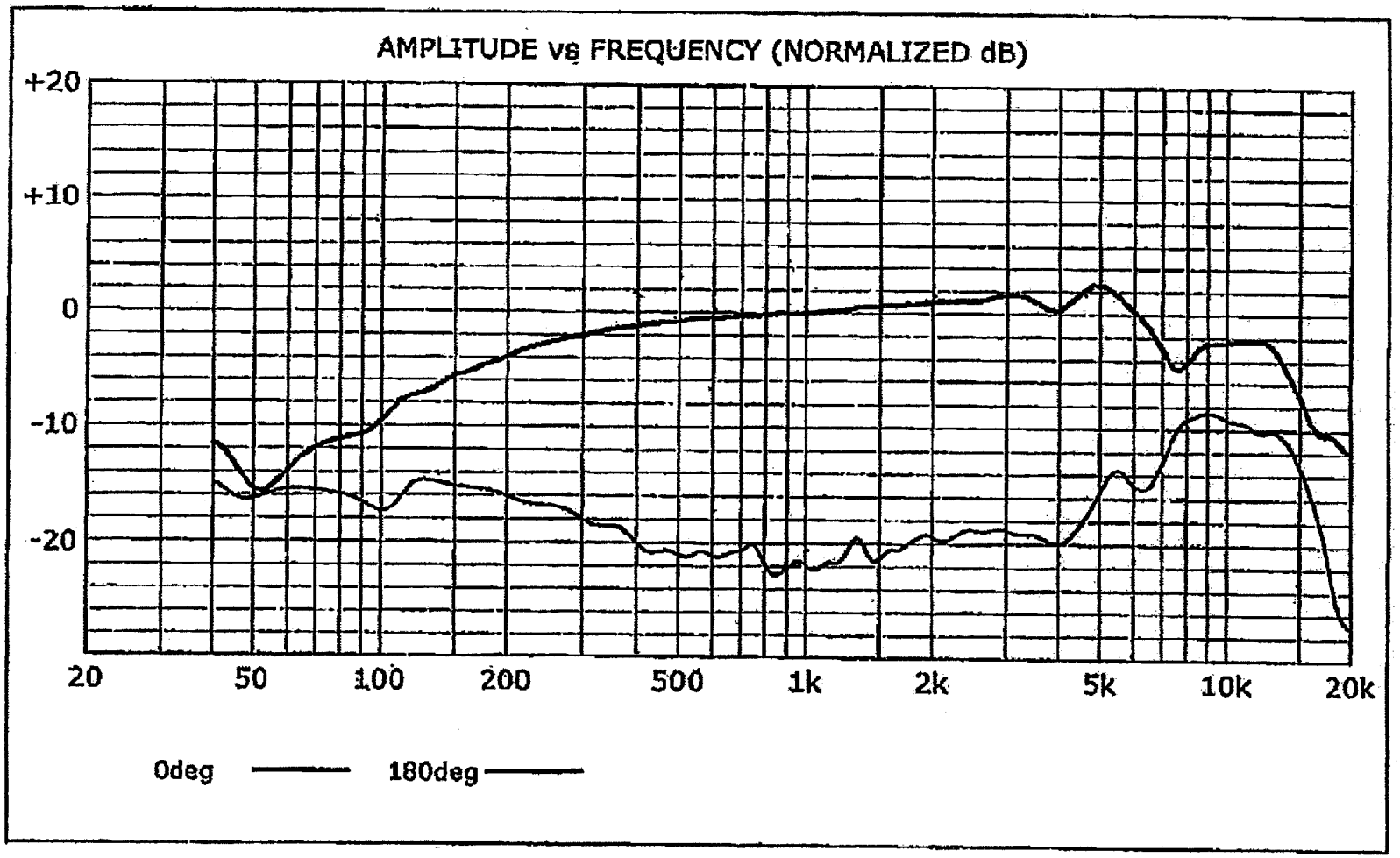
FIG. 3 is a characteristic diagrammatic drawing showing an example of frequency characteristics obtained by the condenser microphone according to the present invention.
Figure 6:
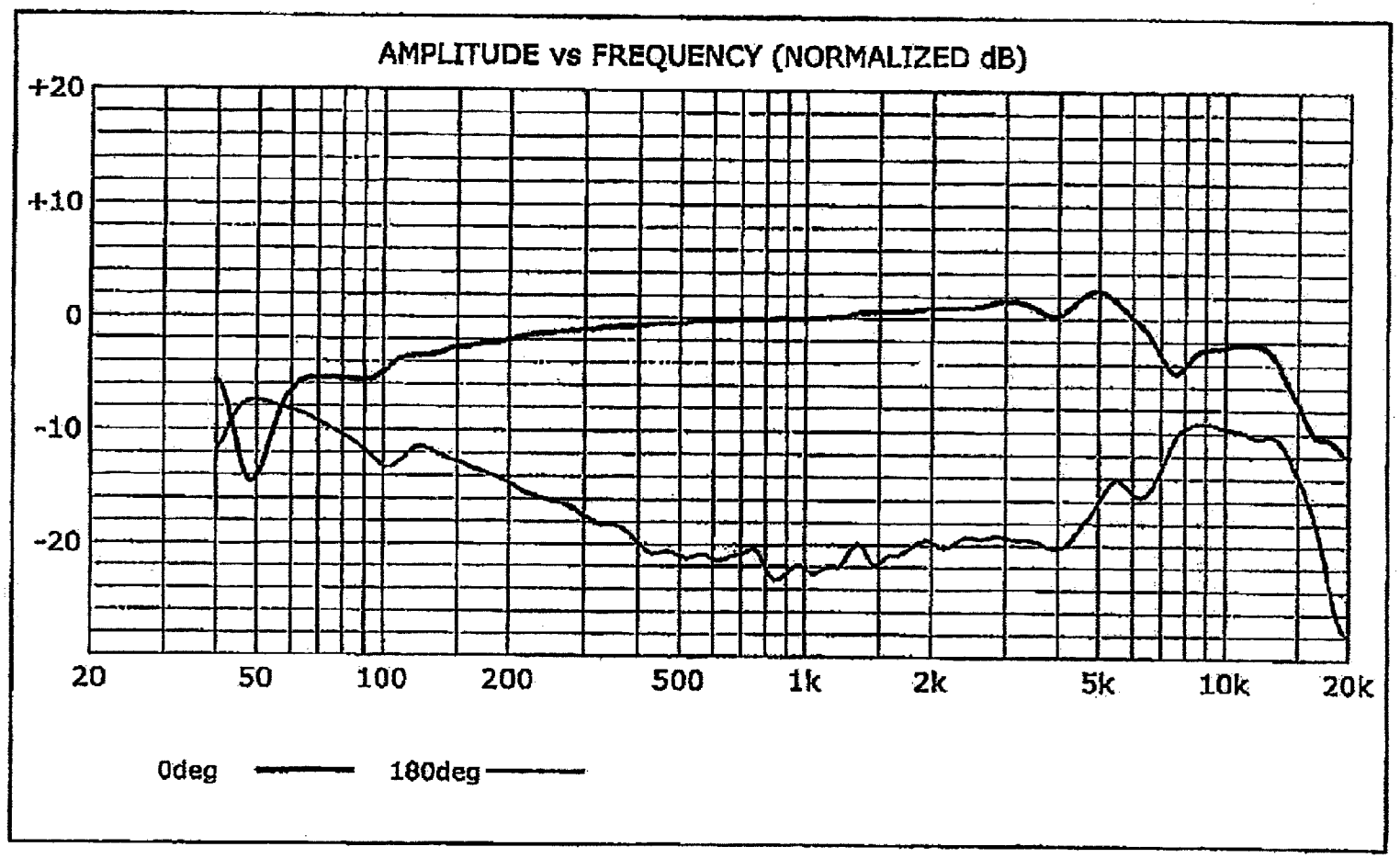
FIG. 6 is a characteristic diagrammatic drawing showing an example of frequency characteristics obtained by a conventional condenser microphone.

FIG. 3 shows the frequency characteristics obtained by the above-described example wherein frequency is plotted as abscissa, and signal level (amplitude) as ordinate. In the graphical representation, the curve on the upper side represented by a thick line indicates the data measured on the front of a microphone, while the curve on the lower side plotted by a line indicates the data measured on the back of the microphone. According to the characteristic curve shown in FIG. 3, it is understood that a low frequency range attenuates. The result becomes clearer in comparison with the frequency characteristics shown in FIG. 6 of a conventional condenser microphone without containing the CR circuit 6. The conventional condenser microphone indicating the result shown in FIG. 6 differs from that of the above-described example in the point that no CR circuit 6 is included, but the other conditions are the same as those of the present condenser microphone.

SECOND EXAMPLE

Figure 2:
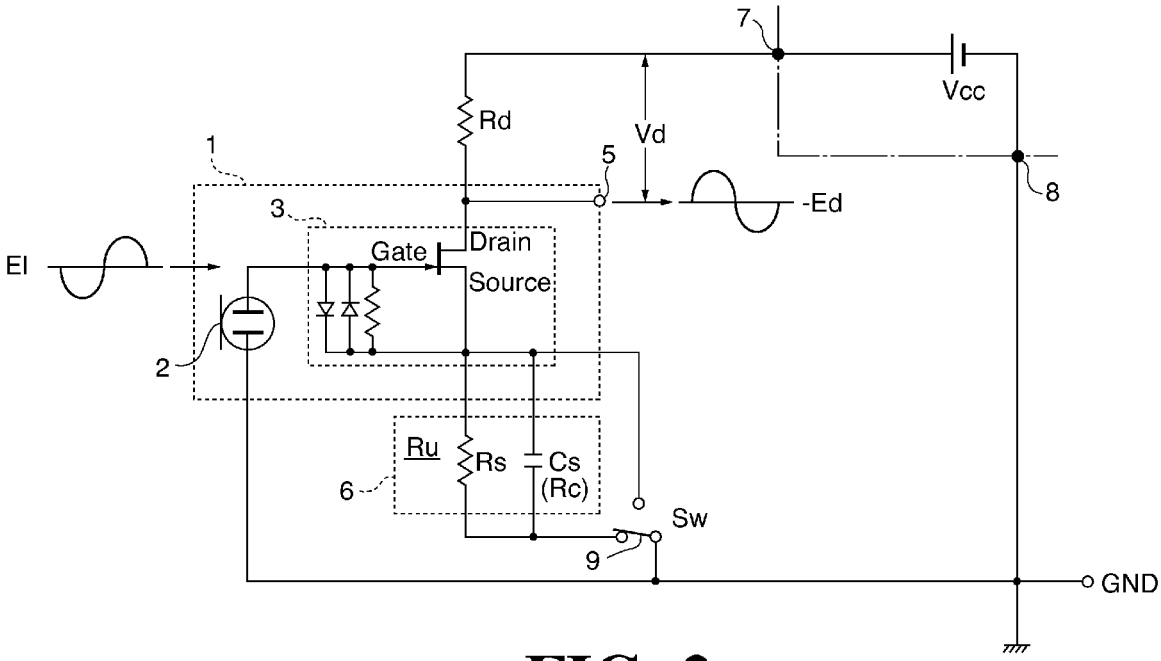
FIG. 2 is a circuit diagram showing another example of the condenser microphone according to the present invention.

Next, the second example shown in FIG. 2 will be described. The present example differs from the example shown in FIG. 1 in the point that a changeover switch 9 is provided in between a source of a FET 3 and the ground GND. The switch 9 is connected in such a manner that a CR circuit 6 is allowed to stand between the source of the FET 3 and the ground GND as illustrated in FIG. 2; and either of a mode wherein the CR circuit 6 acts effectively and a mode wherein the CR circuit 6 is short-circuited, so that the source of the FET 3 is directly grounded to make actions of the CR circuit 6 ineffective may be selected. In the case that the mode wherein the switch 9 makes the actions of the CR circuit 6 ineffective is selected, original frequency characteristics with no modification of a microphone unit 1 can be obtained. Thus, an output terminal is drawn out from only the drain of the FET 3.

On the other hand, in the case that the switch 9 selects the mode wherein the CR circuit 6 acts effectively as illustrated in FIG. 2, such frequency characteristics in which a low frequency range is allowed to attenuate as in the example 1 of FIG. 1 can be obtained. The above-described switch 9 is provided at a suitable position on the microphone case, and it is arranged in such that the switch may be switched in response to a user's choice.

What is claimed is:

1. A condenser microphone comprising:

a mic capsule in which a capacitor is composed of a diaphragm and a counter electrode, and which effects electroacoustic conversion;

a FET for impedance-converting audio signals output from the mic capsule; and a CR circuit composed of a resistor and a capacitor, and connected to the FET to adjust a signal level in a low frequency range, wherein an output terminal is drawn out from a drain of the FET; and the CR circuit is connected in between a source of the FET and the ground, and wherein there is provided a changeover switch for switching a mode in which the CR circuit is connected in between the source of the FET and the ground into another mode in which the CR circuit is short-circuited to connect the source of the FET to the ground.

2. The condenser microphone according to claim 1, wherein an instrument to which the microphone is to be connected adopts plug-in power system and the microphone fits in with the plug-in power system, therefore the condenser microphone can receive power supply from the instrument by connecting the microphone to the instrument.

* * * * *